United States Patent [19]

Krings

[11] 3,999,393

[45] Dec. 28, 1976

[54] CRIBBING PLATE FOR SECURING CONDUIT TRENCHES OR THE LIKE

[76] Inventor: Josef Krings, Hans-Bockler-Strasse 23, D 5138 Heinsberg, Oberbruch, Germany

[22] Filed: July 15, 1975

[21] Appl. No.: 596,068

[30] Foreign Application Priority Data

Nov. 30, 1974 Germany ..... 2456690

[52] U.S. Cl. ..... 61/41 A; 61/106

[51] Int. Cl.[2] ..... E21D 5/10

[58] Field of Search ..... 61/41 A, 41, 63, 72.1; 52/629, 619, 625, 613, 615

[56] References Cited

UNITED STATES PATENTS

| | | | |
|---|---|---|---|
| 3,452,501 | 7/1969 | Zimmer et al. | 52/625 |
| 3,740,916 | 6/1973 | Kenaga | 52/629 |
| 3,750,409 | 8/1973 | Orfei | 61/41 A |
| 3,858,399 | 1/1975 | Krings | 61/41 A |

FOREIGN PATENTS OR APPLICATIONS

| | | | |
|---|---|---|---|
| 1,059,359 | 6/1959 | Germany | 61/41 A |

*Primary Examiner*—Dennis L. Taylor

*Attorney, Agent, or Firm*—Diller, Brown, Ramik & Wight

[57] ABSTRACT

This disclosure relates to a cribbing plate particularly constructed for use in the shoring of walls of trenches. The cribbing plate is of a box construction and includes a rectangular frame formed of shaped metal members which has positioned therein at vertical spaced intervals parallel horizontal reinforcing pieces, and there further being vertical pipe members passing through the horizontal reinforcing members and being welded thereto and to the rectangular frame to reinforce the cribbing plate in a manner to facilitate the driving and pulling thereof. The horizontal reinforcing members are of a C-shaped or more specifically of a flanged channel shape with the flanges being welded to the pipes in a box-like manner to rigidify the cribbing plate.

4 Claims, 5 Drawing Figures

Fig. 2
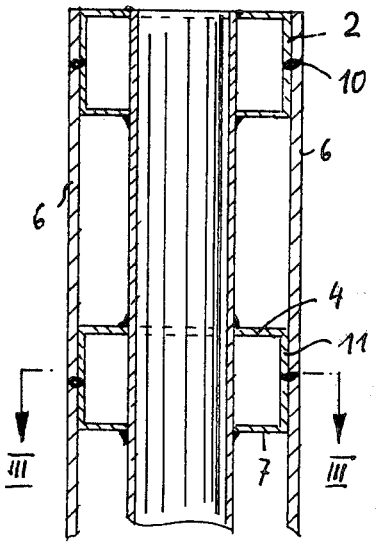
Fig. 4
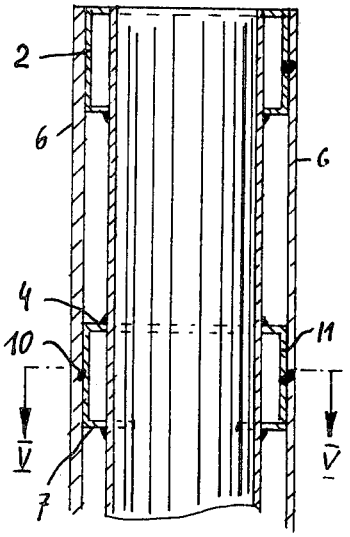
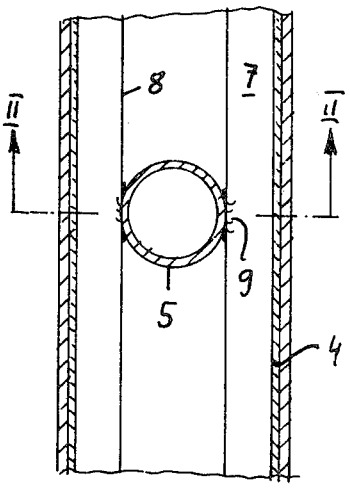
Fig. 3
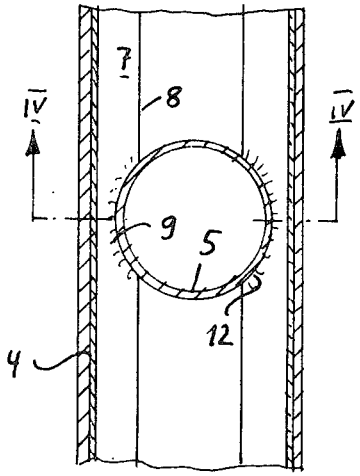
Fig. 5

CRIBBING PLATE FOR SECURING CONDUIT TRENCHES OR THE LIKE

This invention relates to a cribbing plate of a box construction for shoring walls of conduit trenches and the like, the cribbing plate including a rectangular frame formed of shaped metal elements with the frame having positioned therein vertically spaced, parallel horizontal reinforcing members, and there further being a plurality of vertical pipes which extend through the horizontal members of the frame and the horizontal reinforcing members and are connected thereto by welding. The cribbing plate further includes covering sheets that are welded to the frame on opposite sides thereof.

A cribbing plate of this general type is disclosed in German Offertlegeschrift No. 2,230,395. Vertical pipes are used therein so that during the driving and pulling of the cribbing plate, the frame construction will be uniformly loaded and deformation will be restricted.

It has been found, however, particularly in the case of large cribbing plates, that the formation of the horizontal reinforcing members from two U-shaped elements secured together to form an H element does not always provide adequate strength, and that the cribbing plate required still more strength. This was found to be especially true with respect to transverse loading on the flanges of the U elements resulting in the inward yielding of such flanges to the extent that it was questionable that the welding on of the cover plates could not be acceptably effected, and there could be buckling inwardly of the cover plates.

This invention is, therefore, addressed to the problem of producing a cribbing plate utilizing bent metal sheet components for the horizontal reinforcing members with the result that the cribbing plate will present increased rigidity and that there will be provided a better framework for the covering sheet without any increase in weight.

In accordance with this invention, the solution to the problem resides in forming the horizontal reinforcing members of a channel section with inwardly directed terminal flanges such that the channel section has a generally C-shaped cross section such as may be readily formed by bending sheet metal. Associated with this is the provision of pipes of a diameter that is at least as great as the spacing between the free edges of the flanges so that the terminal flanges of the horizontal reinforcing members will at least abut against the pipes.

The use of C-shaped horizontal reinforcing members effects a doubled axial bracing of the pipe with especially good stiffening not only of the frame, but also of the horizontal reinforcing members with the vertical flanges of the horizontal reinforcing members no longer yielding under load.

With the frame of the cribbing plate being so constructed, the cover sheets may be readily secured to the frame, and where desired to the horizontal reinforcing members, by a roller resistance seam welding process.

Further, in order to obtain the bracing of the flanges of the C-shaped horizontal reinforcing members on the pipes over a greater bearing length, it is advantageous to have the diameter of the pipe larger than the spacing between the opposed edges of the flanges with the opposed edges being recessed in a segment-like manner to accept the pipe.

It has even been found possible to save material by improved stiffening of the cribbing plates.

With the above and other objects in view that will hereinafter appear, the nature of the invention will be more clearly understood by reference to the following detailed description, the appended claims and the several views illustrated in the accompanying drawings:

IN THE DRAWINGS:

FIG. 2 is a fragmentary vertical sectional view taken through a slightly modified embodiment of the cribbing plate of FIG. 1 along the line II—II of FIG. 3.

FIG. 3 is a fragmentary horizontal sectional view taken along the line III—III of FIG. 2 and shows further the details of the cribbing plate of FIG. 2.

FIG. 4 is a fragmentary vertical sectional view of the cribbing plate of FIG. 1 and taken along the line IV—IV of FIG. 5.

FIG. 5 is a fragmentary horizontal sectional view taken along the line V—V of FIG. 4.

Figure 1:
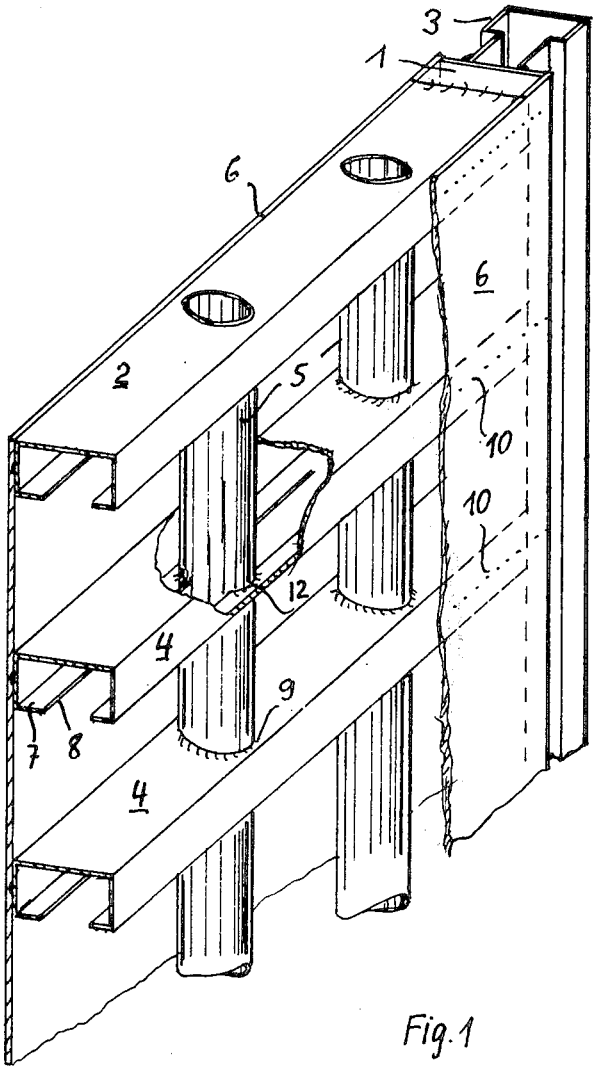
FIG. 1 is a fragmentary perspective view of a cribbing plate formed in accordance with this invention with portions thereof broken away and shown in section in order to clearly illustrate the details of construction.

Referring now to the drawings in detail, it will be seen that there is illustrated in FIG. 1 a portion of a cribbing plate formed in accordance with this invention. The cribbing plate includes a rectangular frame formed of vertical frame members 1 and horizontal frame members 2 which are suitably welded together to form a rigid frame. The frame members 1 and 2 are selectively formed of rolled shaped metal members or of shaped members bent from sheet metal.

In order to facilitate the positioning of the cribbing plate and to facilitate the interlocking thereof with prior driven support posts (not shown), the vertical frame members 1 are provided with vertical guide parts 3 which extend vertically thereof and project horizontally therefrom. It is to be understood that the vertical guide parts 3 are configurated for introduction into grooves of the support posts.

The frame formed of the members 1, 2 and 3 have positioned therein horizontal reinforcing members 4 which are vertically spaced between the horizontal frame members 2 and which have the ends thereof suitably secured to the vertical frame members 1. The horizontal frame members 4 are preferably in the form of channels having opposed, spaced apart, terminal flanges 7. It will be apparent from the drawings that the horizontal reinforcing members are generally C-shaped in cross section and are preferably bent from sheet metal.

The frame construction also includes vertical pipes 5 which are spaced longitudinally of the cribbing sheet. The vertical pipes 5 preferably extend through suitable openings not only in the horizontal reinforcing members 4, but also in the horizontal frame members 1. The vertical pipes 5 are open at the top and bottom and serve essentially for direct acceptance of the forces of driving and retraction during the positioning and removal of the cribbing plate.

On the frame formed primarily of the frame members 1 and 2, the horizontal reinforcing members 4 and the vertical pipes 5 are secured covering plates 6 which are welded to opposites sides of the frame and completely enclose the same.

In the embodiment of the cribbing plate specifically illustrated in FIGS. 2 and 3, it will be seen that the terminal flanges 7 of each horizontal reinforcing member 4 have edges 8 which are spaced apart a distance substantially equal to the diameter of the pipe 5. Thus, when the pipes 5 are passed through the horizontal reinforcing member 4, they slide between the flanges 7. The pipes 5 are secured to the horizontal reinforcing members by suitable welding 9.

As is clearly shown in FIG. 2, the opposed flanges 7 abut against the pipes 5 so that the horizontal reinforcing members receive particularly great rigidity and thereby form a rigid box element in combination with the pipes 5. This relationship imparts great stability of form to the cribbing plate. Further, it allows the covering sheet 6 to be fastened such as by a resistance roller electrode weld seam 10, to vertical flanges 11 of the horizontal reinforcing members 4, as is clearly shown in FIG. 2.

In FIGS. 1, 4 and 5, the illustrated cribbing plate is of a slightly different construction, the difference being solely in the relationship of the spacing of the edges 8 of the flanges 7 with respect to the diameter of the pipes 5. As is clearly shown in FIG. 5, the spacing of the edges 8 of the flanges 7 is less than the diameter of the pipes 5. In the illustrated embodiment of the invention, the flanges 7 are of the same width and the spacing between the edges 8 is the same as that illustrated in FIG. 3, and the pipe 5 is made of a larger diameter. Of course, the pipe 5 could be of a smaller diameter and the flanges 7 could be of greater widths with the result that the spacing between the edges 8 would be less. In order to receive the pipes 5, the flanges 7 are provided with segment-like recesses 12. The pipes 5 are secured to the horizontal reinforcing members 4 by welding 9 in the same general manner as that disclosed with respect to the embodiment of FIGS. 2 and 3.

In the embodiment of FIGS. 1, 4 and 5, the transverse forces acting on the cribbing plate are distributed over a greater part of the periphery of the pipe 5 along the edges of the recesses 12. In this manner, more favorable strength values are obtainable which also may permit saving in materials either in the number of horizontal reinforcing members 4 or in the thickness of the material from which they are formed. At the same time, there is a less transverse loading on the pipes 5.

As in the case of the embodiment of FIGS. 2 and 3, the frame construction of the embodiments of FIGS. 1, 4 and 5 also provides ideal conditions for the application of the covering sheets by means of resistance roller electrode welding.

Although only several preferred embodiments of the cribbing plate have been specifically illustrated and described herein, it is to be understood that minor variations may be made in the cribbing plate construction without departing from the spirit and scope of the invention, as defined by the appended claims.

WHAT IS CLAIMED AS NEW:

1. A cribbing plate for use in shoring conduit trenches and the like, said cribbing plate being of a flat box construction and comprising a peripheral frame of shaped metal members including uprights and horizontal frame members, a plurality of horizontal reinforcing members positioned within said frame in spaced parallel relation and secured to said uprights, a plurality of upright tubular members extending through said horizontal reinforcing members and having end portions secured to said horizontal frame members, said horizontal reinforcing members each being of a C-shaped cross section and including spaced opposed horizontally disposed terminal flanges, the dimension of said tubular members in the direction of the spacing between said terminal flanges being at least as great as the spacing between said opposed terminal flanges with said terminal flanges abutting against said tubular members and reinforcing said horizontal reinforcing members against inward collapse, and covering sheets secured to opposite sides of said frame.

2. A cribbing plate according to claim 1 wherein said flanges are secured to said tubular members by welding.

3. A cribbing plate according to claim 1 wherein opposed edges of said terminal flanges abut said tubular members.

4. A cribbing plate according to claim 1 wherein said tubular members have a dimension in the direction of spacing between said terminal flanges greater than the spacing between opposed edges of said terminal flanges, and edges of said terminal flanges are notched and said tubular members are partially seated therein.

* * * * *